United States Patent [19]

Golub et al.

[11] 3,973,819

[45] Aug. 10, 1976

[54] SOCKET CLAMP

[75] Inventors: Samuel G. Golub, Jackson Heights; Charles E. Klagges, Lindenhurst, both of N.Y.

[73] Assignee: Graham-Field Surgical Co., Inc., New Hyde Park, N.Y.

[22] Filed: Apr. 7, 1975

[21] Appl. No.: 565,694

[52] U.S. Cl. ..... 339/209

[51] Int. Cl.[2] ..... H01R 13/54

[58] Field of Search..... 339/209, 135, 136, 139 R, 339/139 C, 124, 180; 240/153, 133, 81 R, 81 BD, 81 BS, 81 BE

[56] References Cited

UNITED STATES PATENTS

| | | | |
|---|---|---|---|
| 1,430,827 | 10/1922 | Moeckel | 240/81 BS |
| 1,483,355 | 2/1924 | Kupsche | 240/81 BD |
| 2,116,518 | 5/1938 | Hubbell, Jr. | 339/139 R |

*Primary Examiner*—Joseph H. McGlynn
*Attorney, Agent, or Firm*—Bauer, Amer & King

[57] ABSTRACT

A device to clamp the upper and lower body parts of an electrical socket including a collar adapted to seat on the upper body part and a plate coupled to the collar to react against the lower body part to effect a compressive load between the body parts to lock them together.

1 Claim, 4 Drawing Figures

SOCKET CLAMP

This invention relates to a clamp and more particularly the present invention relates to an external clamp for electrical sockets and fixtures.

Common electrical sockets and fixtures comprise two body parts. The first and lower body part is essentially cup-shaped and has a nipple portion through which the electrical wires extend. The second and top body part is substantially of cylindrical configuration and has one end thereof in mating engagement with an enlarged cross sectional portion of the first part. Cost considerations usually dictate that the line or area of mating engagement between the two body parts be a plurality of complementary raised bosses and locking detents. In many, if not most, applications such an arrangement is entirely satisfactory in the sense that rarely does either body part experience a pull or force along its longitudinal axis tending to separate the same.

However, in certain design configurations, particularly where the socket is coupled to a "goose neck", many users inadvertently grasp the socket reflector or shade whose mechanical connection to the goose neck and socket transfers a longitudinal load onto the second or top body part. Worse yet, in some applications the socket is attached to the goose neck without a protective reflector or other external structure and when such is the case, the socket is continually, albeit unintentionally, "slapped" in moving the light. Such rough handling of the socket assembly invariably leads to body part separation with consequent hazards of shock, sparks and fire.

It is, therefore, an object of the present invention to provide a device to prevent separation of the body parts of an electrical socket.

It is another object of the present invention to provide an external socket clamp particularly adapted to a goose neck support and mountable thereon without requiring modification thereof.

It is a further object of the present invention to provide a socket clamp that is simple in design and easy and inexpensive to manufacture.

Other objects and features of the present invention will become apparent from the following detailed description considered in connection with the accompanying drawing. It is to be understood, however, that the drawing is designed for purposes of illustration only and not as a definition of the limits of the invention for which reference should be made to the appending claims.

In the drawing wherein the same reference numeral denotes the same element throughout the several views.

Figure 1:
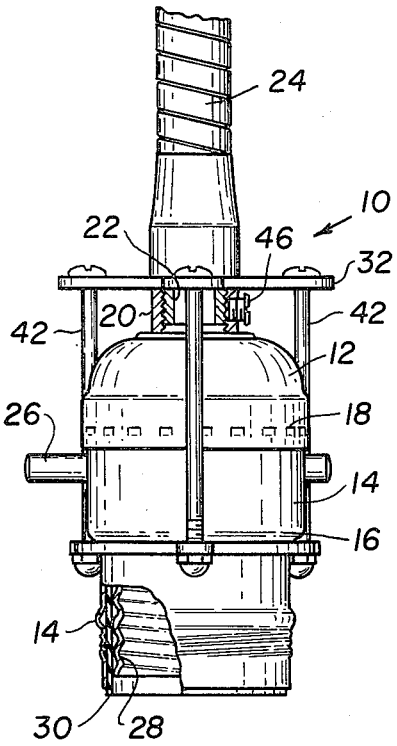
FIG. 1 is a plan view of the inventive socket clamp showing the same attached to the socket with parts of the socket in section for purposes of clarity.
Figure 3:
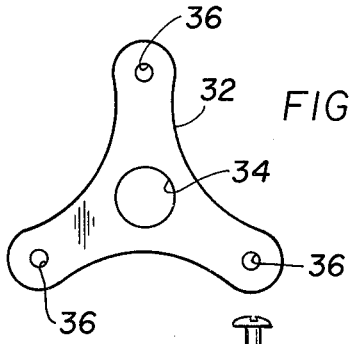
FIG. 3 is a plan view of another element of the socket clamp.
Figure 4:
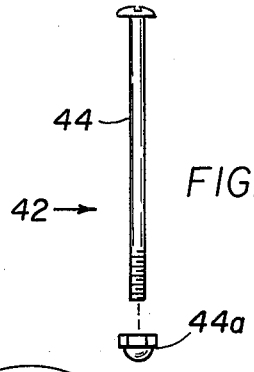
FIG. 4 is an elevational view of the third and screw element of the inventive clamp.
Figure 2:
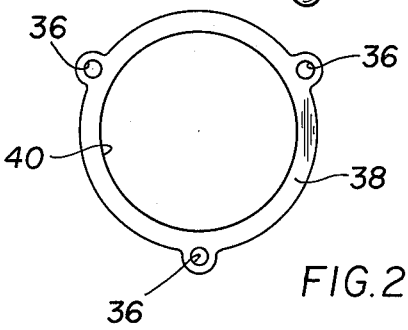
FIG. 2 is a plan view of one element comprising the inventive socket clamp.

Referring now to FIGS. 1 through 4, there is shown the inventive socket clamp generally indicated by reference numeral 10. A standard light socket is defined by a first and lower part 12 and a second and upper body part 14. The last mentioned body part is further defined by a discontinuity in cross section giving rise to an external annular shoulder 16. Lower part 12 also includes a cross section discontinuity or area of enlargement 18 with which it frictionally receives a complementary portion of upper body part 14 as shown. Conventionally, the aforesaid complementary mating portion of part 14 is formed with raised bosses or perturbations while cross sectional enlargement 18 carries a plurality of complementary locking detents.

Lower body part 12 further carries a threaded nipple 20 to threadably engage a complementary threaded stud 22 carried on goose neck 24. The socket also includes finger operable switch means 26 as well as bulb threads 28 electrically isolated from body part 14 by insulation 30.

Clamp 10 includes a reactive plate 32 having a central aperture 34 sized to be received on threaded stud 22. Plate 32 has a plurality of holes, screw apertures or bores 36. The clamp 10 is further defined by a lock collar 38 formed with a central aperture 40 designed to fit over that portion of upper part 14 carrying bulb threads 28 and seat on and react against shoulder 16 as shown. Lock collar 38 likewise includes a plurality of holes or screw bores 36 disposed in a corresponding number and configuration to those bores 36 of plate 32 to form corresponding sets. A plurality of detachable coupling means, indicated generally by reference numeral 42, preferably includes a threaded stud 44 and nut **44*a* with the stud received through an associated pair or set of bores 36 in plate 32 and collar 38**.

Operation of the inventive clamp is readily apparent. Reactive plate 32 is received over threaded stud 22. Socket 10 and more particularly nipple 20 thereof is screwed onto the stud whereby the leading edge of the nipple interferes with the contiguous portions of plate 32 defining aperture 34 locking the plate onto the stud between the nipple and stud. A set screw 46 retains the stud and nipple in threaded engagement. Collar 38 is then slipped over that portion of body part 14 carrying threads 28 until the collar rests against shoulder 16.

In the embodiment shown, the coupling means 42 are received through complementary sets or pairs of bores 36 defined in the aligned plate 32 and collar 38. A nut 44a is threaded onto the threaded end of each stud 44 with the nuts 44a being on the outboard face of collar 38 as shown. Tightening nuts 44a drive collar 38 against shoulder 16 which action places a compressive coupling and clamping load between body parts 12 and 14. Not only are the body parts now compressively clamped, plate 32 and hence clamp 10 are firmly attached to stud 22 and to the goose neck 24.

While only a few embodiments of the present invention have been shown and described, it is to be understood that many changes and modifications can be made hereto without departing from the spirit and scope hereof. It is the intention, therefore, to be limited only as indicated by the scope of the claims appended hereto.

What is claimed is:

1. A clamping device for a light socket wherein the socket is adapted for attachment to a goose neck stud and has a lower body part defined by a tapped nipple to thread onto the stud and an upper body part having a shouldered portion and which is frictionally retained in the lower body part, said device including a reactive plate formed with a central aperture through which passes the stud for threaded engagement with the tapped nipple and against which the nipple reacts to lock said plate therebetween and the socket onto the goose neck, a collar formed with a central aperture to seat on the shouldered portion of the upper body part, and means to apply a compressive load between said collar and plate and thereby compressively lock the upper and lower body parts together, said means including a plurality of complementary bores in said collar and plate and connecting rod means received through an associated pair of said complementary bores to thereby compressively lock the upper and lower body parts.

* * * * *